US005511609A

United States Patent [19]

Tyler

[11] Patent Number: 5,511,609

[45] Date of Patent: Apr. 30, 1996

[54] TUBE SHIELD WITH TONGUE AND LOCKING BLOCK ASSEMBLY

[76] Inventor: John T. Tyler, 6045 S. Gulf Manor Dr., Pensacola, Fla. 32526

[21] Appl. No.: 371,999

[22] Filed: Jan. 12, 1995

[51] Int. Cl.[6] ..... F28F 19/00

[52] U.S. Cl. ..... 165/134.1; 122/DIG. 13

[58] Field of Search ..... 165/134.1; 122/DIG. 13; 138/110

[56] References Cited

U.S. PATENT DOCUMENTS

| | | | |
|---|---|---|---|
| 2,646,818 | 7/1953 | Bimpson . | |
| 4,228,978 | 10/1980 | Rand . | |
| 4,619,314 | 10/1986 | Shimoda . | |
| 4,682,568 | 7/1987 | Green et al. | 122/235 C |
| 4,776,790 | 10/1988 | Woodruff . | |
| 4,809,621 | 3/1989 | Materna . | |
| 4,934,322 | 6/1990 | Fournier et al. . | |
| 5,154,648 | 10/1992 | Buckshaw . | |
| 5,220,957 | 6/1993 | Hance . | |

*Primary Examiner*—Allen J. Flanigan
*Attorney, Agent, or Firm*—Popham, Haik, Schnobrich & Kaufman, Ltd.

[57] ABSTRACT

A tube and tube shield assembly comprising a cylindrical tube having an exterior surface and a locking block extending radially outwardly from the exterior surface, and a tube shield mounted on the tube immediately above the locking block. The tube shield includes a semi-cylindrical body portion having a radius substantially equal to that of the tube, and a tongue extending outwardly from an end or a side edge of the body portion and inserted through an aperture in the locking block. Retaining straps retain the body portion in tight engagement with the tube. Preferably, there are two retaining straps, which are inset from the first and second end edges, respectively, of the body portion, each of the retaining straps having ends overlapping the side edges of the body portion. The tongue is bent away from the tube to lock the tongue, and consequently the attached body portion, in place. In an alternate embodiment, tongues can be provided at both end edges for engagements with a pair of spaced locking blocks. In another alternate embodiment, one end of the tube shield is provided with a sleeve portion to enable overlapping of tube shields end-to-end. The sleeve portion is provided with a tongue at its end edge, for engagement with a locking block inset from the opposite end edge of the body portion.

21 Claims, 3 Drawing Sheets

TUBE SHIELD WITH TONGUE AND LOCKING BLOCK ASSEMBLY

BACKGROUND OF THE INVENTION

1. Field of the Invention

The present invention relates to shields used for shielding tubes in power or recovery boilers. More specifically, the invention relates to tube shields which are secured to the tubes using a tongue and locking block assembly.

2. Related Art

As described in U.S. Pat. No. 5,220,957 to Hance, which is incorporated herein by reference in its entirety, three common methods of installing tube shields on boiler tubes are the U-bolt system (shown in FIGS. 1 and 4 of Hance); the snap system (shown in FIGS. 2 and 5 of Hance); and the welded U-strap system (shown in FIGS. 3 and 6 of Hance). As is noted by Hance, once the tube shields of these systems have been installed on the tubes and the boiler is placed in service, they tend to loosen, rotate, and slip axially due to expansion and contraction resulting from temperature fluctuations. A fourth method is described in U.S. Pat. No. 4,619,314 to Shimoda and employs pins which extend through projections on the sides of the tube shields.

Hance's invention is directed to a lug and slot installation which provides improved protection against loosening, rotation, and axial slippage of the tube shield in comparison to the U-bolt, snap, and welded U-strap systems; and a simpler but equally effective construction in comparison to Shimoda's system. It also provides the advantage of being usable in both horizontal and vertical orientations. However, Hance's lug and slot installation has to pass inspection before installation.

Specifically, the lug in Hance's installation is secured to the existing boiler tube by welding. This weld has to be tested by non-destructive testing (NDT) personnel to assure that it is acceptable, and that no leakage occurs. If the weld is not acceptable, then repairs have to be made and the weld tested again. The tube shield itself cannot be installed until this procedure has been accomplished, due to the fact that the tube shield, once installed, will restrict any required repair of the weld on the lug.

Every time testing of the welds is required, all personnel must be evacuated from the inside of the boiler, to allow the NDT personnel to work. This procedure is extremely costly.

Only after all lugs have been installed, tested, and approved or repaired can the tube shield be installed. Two workers are required for installation of each tube shield, because the shield must be held in place by one worker wile the other one welds at least one of the retainer straps in place. As the tube shields are installed in locations in the boilers above where other people are working, there is the potential for serious injury if one of the shields were to fall.

Further, the slot openings of Hance's lug and slot installation provide a place where build-up of residue occurs, and leave some of the underlying tube exposed and subject to wear and erosion. It is to the solution of these and the above problems to which the present invention is directed.

SUMMARY OF THE INVENTION

It is therefore a primary object of the present invention to provide a tube and tube shield assembly in which the assembly of the tube shield to the tube prevents rotation and axial slippage resulting from expansion and contraction of the components.

It is another object of the present invention to provide a tube and tube shield assembly which eliminates spots where residue build-up can occur.

It is another object of the present invention to provide a tube and tube shield assembly which does not leave portions of the tube exposed under the tube shield.

It is still another object of the present invention to provide a tube and tube shield assembly in which the tube shield can be installed before any NDT is done.

It is still another object of the present invention to provide a tube and tube shield assembly in which the tube can be inspected at any time without removing the tube shield.

These and other objects of the invention are achieved through the provision of a tube and tube shield assembly comprising a cylindrical tube having an exterior surface and a locking block extending radially outwardly from the exterior surface, and a tube shield mounted on the tube immediately above the locking block. The tube shield includes a semi-cylindrical body portion having an inner radius substantially equal to the outer radius of the tube, and a tongue extending outwardly from an end or side edge of the body portion and inserted through an aperture in the locking block. Retaining straps retain the body portion in tight engagement with the tube. Preferably, there are two retaining straps, which are inset from the first and second end edges, respectively, of the body portion, each of the retaining straps having ends overlapping the side edges of the body portion.

In one aspect of the invention, the tongue is bent away from the tube to lock the tongue, and consequently the attached body portion, in place.

In another aspect of the invention, the locking block is generally U-shaped, and has a rectangular or a rounded profile.

In an alternate embodiment of the invention, tongues are provided at either end edge of the body portion for engagement with locking blocks spaced from either end edge of the body portion. One tongue is shorter than the other tongue, and the distance between the two locking blocks is approximately equal to the combined length of the body portion and the shorter of the two tongues. These proportions enable the body portion to be slid between the two locking blocks to insert both tongues in their respective locking blocks.

In another alternate embodiment of the invention, one end of the tube shield is provided with a sleeve portion to enable overlapping of tube shields end-to-end. The sleeve portion is provided with a tongue at its end edge, for engagement with a locking block inset from the opposite end edge of the body portion.

The locking block used in the tube and tube shield assembly in accordance with the present invention is secured to the existing boiler tube by a welding process, and requires inspection of the weld prior to installation of the tube shield. However, all welds can be made and the tube shield can be installed in its entirety before testing because the weld on the locking block is completely exposed after installation of the tube shield. Thus, it is possible to make repairs, if required, after installation of the tube shield. Also, because repairs can be made after installation, NDT can be scheduled when the work force is reduced, rather than having to evacuate a whole work force.

Further, the tube shield in accordance with the invention is secured and self-supporting once the tongue is inserted into the locking block. Therefore, regardless of whether it is oriented horizontally or vertically, the tube shield can be applied by a single person.

A further advantage of the tube shield in accordance with the invention is that it can be moved from one position to another by a single person, and simply by removing the tongue from the locking block. In contrast, the lug and slot installation by Hance requires removal of the retainer straps if the tube shield is to be moved.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
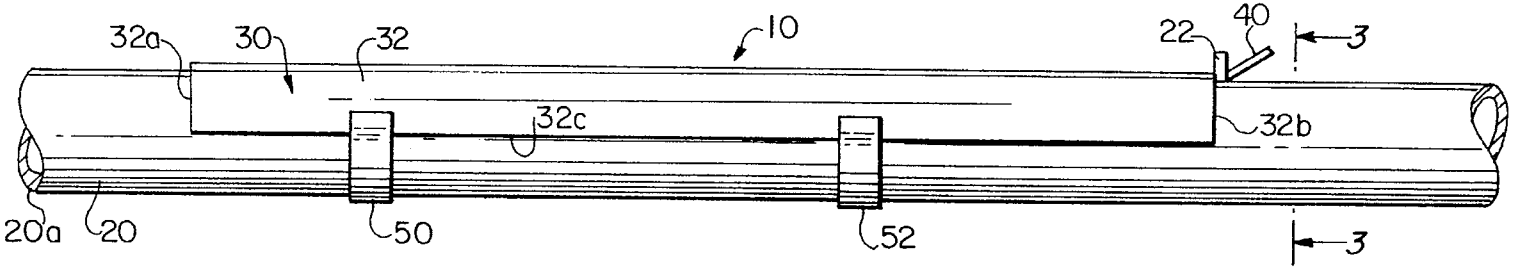
FIG. 1 is a side elevational view of a tube and tube shield assembly in accordance with a first embodiment of the present invention, having a locking block with a rectangular profile.
Figure 2:
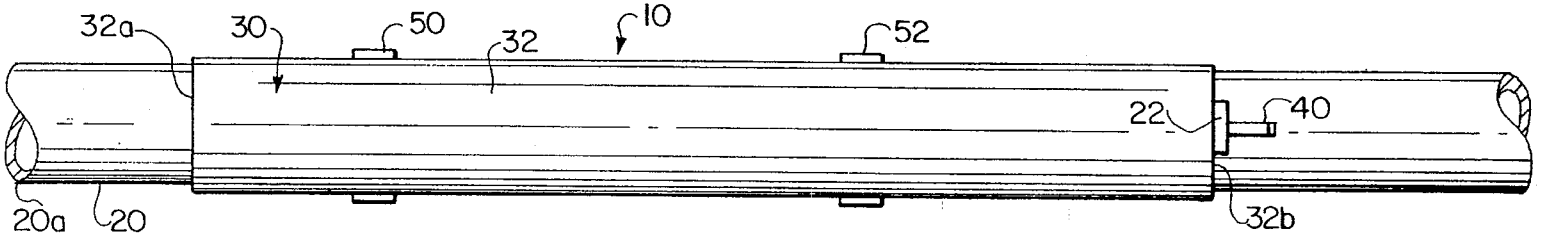
FIG. 2 is a front elevational view of the tube and tube shield assembly of FIG. 1.
Figure 3:
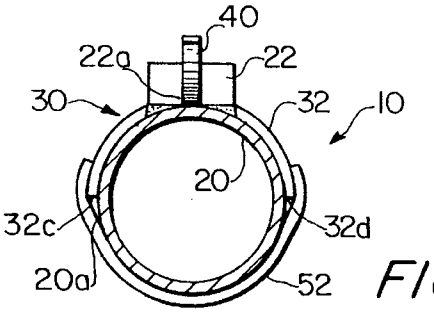
FIG. 3 is a cross-sectional view taken along line 3—3 of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 4:
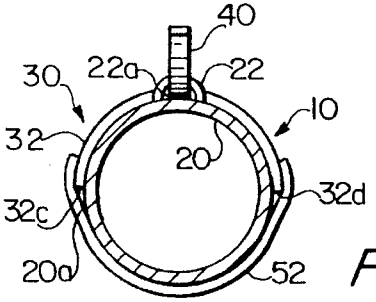
FIG. 4 is a cross-sectional view of a tube and tube shield assembly in accordance with the present invention, having a locking block with a curved profile.
Figure 5:
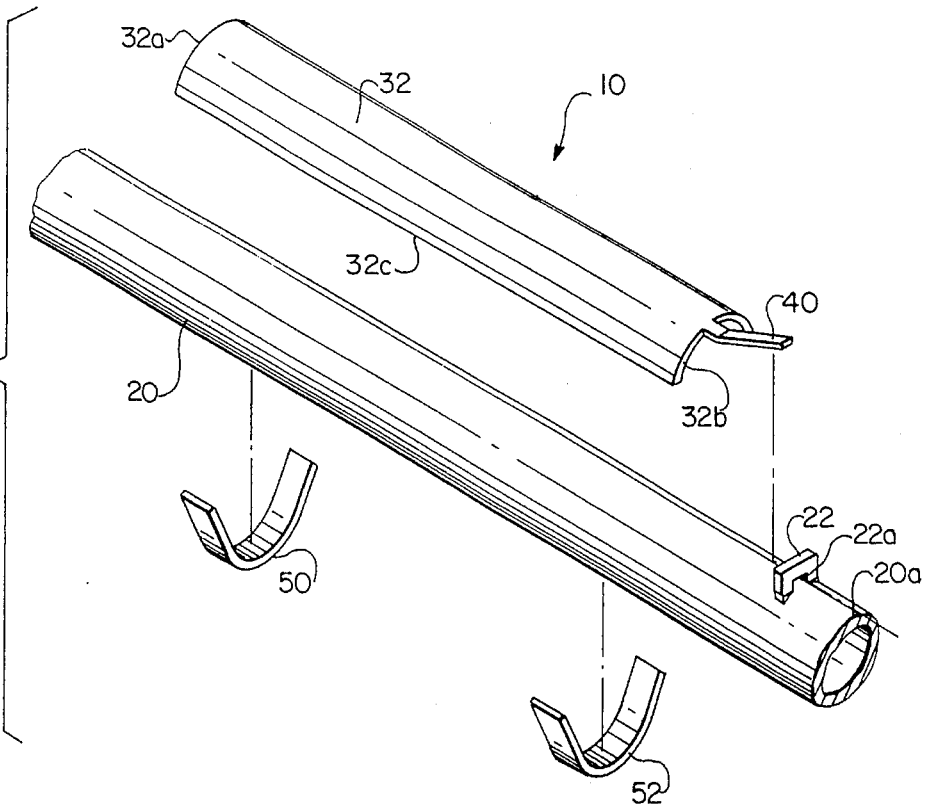
FIG. 5 is an exploded perspective view of the tube and tube shield assembly of FIG. 1.
Figure 6:
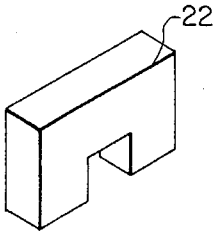
FIG. 6 is a perspective view of a locking block having a rectangular profile.
Figure 7:
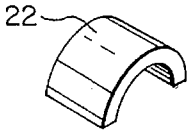
FIG. 7 is a perspective view of a locking block having a curved profile.

Referring now to FIGS. 1–3 and 5, there is shown a tube and tube shield assembly 10 in accordance with a first embodiment of the present invention. Tube and tube shield assembly 10 comprises a cylindrical tube 20 and a tube shield 30 assembled to tube 20. Tube 20 has an exterior surface 20*a* and a locking block 22 affixed to and extending radially outwardly from exterior surface 20*a*. Locking block 22 is generally U-shaped, and can be rectangular in profile, as shown in FIGS. 1–3, 5, and 6, or rounded in profile, as shown in FIGS. 4 and 7, or any other suitable profile which provides an aperture 22*a* when joined to exterior surface 20*a*. As will be appreciated by those of skill in the art, the material used for locking block 22 must be compatible with the material used for tube 20. Carbon steel generally is a suitable material for locking block 22.

Tube shield 30 includes a semi-cylindrical body portion 32 having substantially the same radius as tube 20 (i.e, having an inner radius substantially the same as the outer radius of tube 20), and dimensioned to cover approximately one-half of the circumference of tube 20. Its length will vary according to the application. Body portion 32 has first and second opposed end edges 32*a* and 32*b* and first and second opposed side edges 32*c* and 32*d*. A tongue 40 extends outwardly from, and is formed unitarily with, second end edge 32*b*. Although tongue 40 ordinarily is positioned approximately midway between side edges 32*c* and 32*d*, it can be positioned off-center, if required by a specific application.

As will readily be appreciated, where tube and tube shield assembly 10 is oriented horizontally, second end edge 32*b* can be oriented either to the left or to the right; and where tube and tube shield assembly 10 is oriented vertically, second end edge 32*b* preferably is positioned below first end edge 32*a*. Tongue 40 is dimensioned for insertion through aperture 22*a*. Because tongue 40 is bent upwardly (i.e., away from exterior surface 20*a* of tube 20), it locks body portion 32 in place.

Body portion 32 is further held in place on tube 20 by additional retaining means such as a pair of retainer straps 50 and 52. Preferably, retainer straps 50 and 52 each comprise a metal strap extending around the unshielded portion of tube 20 and overlapping side edges 32*c* and 32*d*. Retainer straps 50 and 52 fit tightly around tube 20, with their ends overlapping side edges 32*c* and 32*d*, preferably by at least ½ inch (1.27 cm). In order to achieve the desired tight fit, retainer straps 50 and 52 are generally U-shaped, being formed to 180° in the portion which extends around the unshielded portion of tube 20, with a substantially straight portion of approximately ½ inch at the ends where they overlap side edges 32*c* and 32*d*. Retainer straps 50 and 52 are welded in place on body portion 32, as will be described in greater detail hereinafter. Preferably, retainer straps 50 and 52 are inset from end edges 32*a* and 32*b*; insertion of tongue 40 through locking block 22 precludes the need for additional retainer straps 36 intermediate retainer straps 50 and 52.

Suitable materials for tube shield 30 (including straps 50 and 52) include stainless and carbon steel.

The effectiveness of tube and tube shield assembly 10 depends upon proper affixation of locking block 22 to tube 20. Affixation of locking block 22 in turn depends upon proper preparation of tube 20. As a first step, an area to be cleaned is established on exterior surface 20*a* surrounding the point where locking block 22 is to be placed. The area to be cleaned preferably extends axially a minimum of 4 inches (5.08 cm). Second, the selected area is cleaned, for example using an air grinder burr motor with a No. 60 grit flapper wheel. Third, a die penetrate test is applied to the cleaned area, extending 90° to each side of where locking block 22 is to be placed. Fourth, the exact location of locking block 22 is established and marked.

Figure 8:
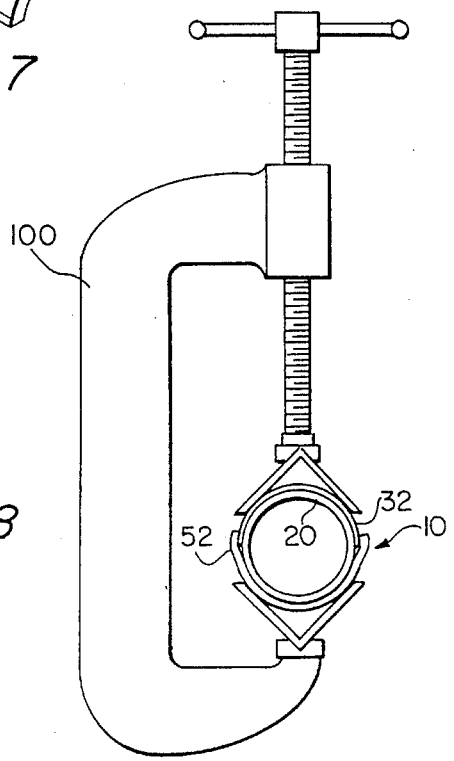
FIG. 8 is an end elevational view of a retainer strap being assembled to the tube and tube shield assembly of the present invention, using a modified "C" clamp.

Once exterior surface 22*a* has been properly prepared, locking block 22 is welded to its established location. All welds should be terminated on locking block 22, and must not extend beyond either end of locking block 22. With locking block 22 welded in place, body portion 32 is assembled to tube 20 by inserting tongue 40 through aperture 22*a* and placing body portion 32 tightly against tube 20. Tongue 40, being bent upwardly as previously described, locks body portion 32 in place. Finally, retainer straps 50 and 52 are welded into place overlapping the end edges 32*c* and 32*d* of body portion 32. In order to tighten retainer straps 50 and 52 against body portion 32, a modified "C" clamp 100 can be used, as illustrated in FIG. 8.

Figure 9:
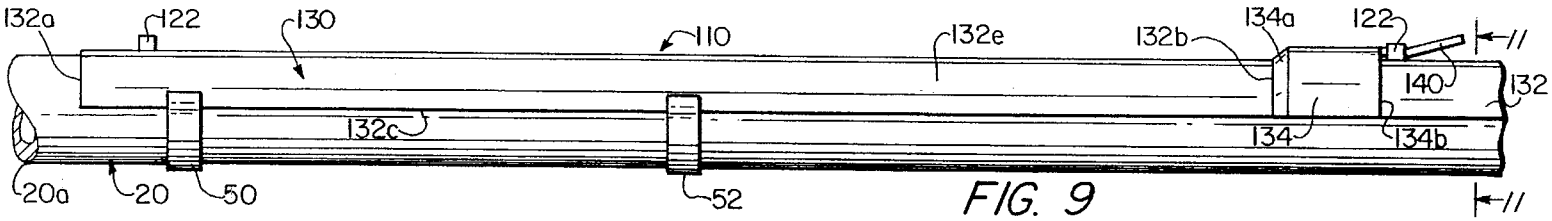
FIG. 9 is a side elevational view of a tube and tube shield assembly in accordance with a second embodiment of the present invention.
Figure 10:
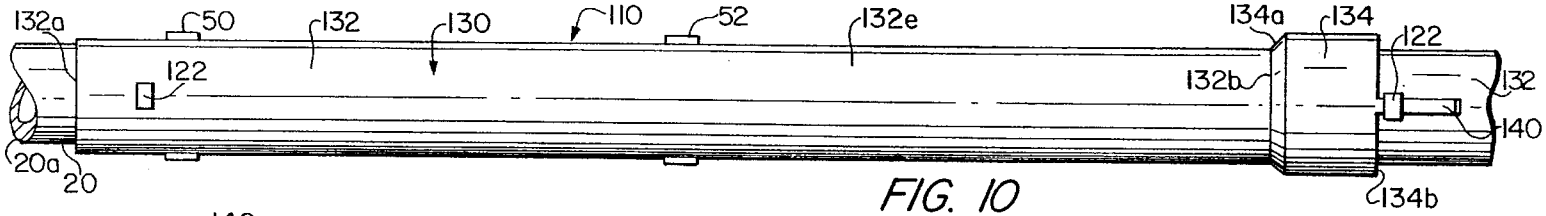
FIG. 10 is a front elevational view of the tube and tube shield assembly of FIG. 9.
Figure 11:
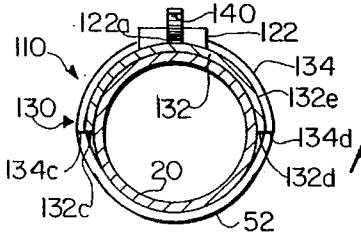
FIG. 11 is a cross-sectional view taken along line 11—11 of FIG. 9.

Referring now to FIGS. 9–11, there is shown a tube and tube shield assembly 110 in accordance with a second embodiment of the present invention. Tube and tube shield assembly 110 comprises a cylindrical tube 20 identical to that described above with respect to the first embodiment, and a tube shield 130 assembled to tube 20.

Tube shield 130 includes a semi-cylindrical body portion 132 and an enlarged semi-cylindrical sleeve portion 134. Body portion 132 has an inner radius substantially the same as the outer radius of tube 20, and is dimensioned to cover approximately one-half of the circumference of tube 20. Its length will vary according to the application.

Body portion 132 has first and second opposed end edges 132*a* and 132*b*, first and second opposed side edges 132*c* and 132*d*, and an exterior surface 132*e*. Sleeve portion 134 is coaxial with and extends from second end edge 132*b* of body portion 132 and is unitary with body portion 134. It has an inner radius substantially the same as the outer radius of body portion 132. Sleeve portion 134 has a transition portion 134*a* joined to second end edge 132*b* of sleeve portion 134*a*, an end edge 134*b* opposite transition portion 134*a*, and first and second opposed side edges 134*c* and 134*d* which are co-extenstive with first and second opposed side edges 132*c* and 132*d* of body portion 132.

A locking block 122 is affixed to and extends radially outwardly from exterior surface 132*e* at a position inset from first end edge 132*a* by a distance approximately equal to the length of sleeve portion 134. Thus, the first end edge 132*a* of one tube shield 130 can be inserted into the sleeve portion 134 of a second identical, adjacent tube shield 130. When so inserted, the locking block 122 of the first tube shield will be adjacent the end edge 134*b* of the sleeve portion 134 of the second tube shield 130. This ability to join multiple tube shields 130 together is particularly advantageous in applications where the tubes 20 are very long.

Locking block 122 is similar to locking block 22, and thus is generally U-shaped, and can be rectangular in profile, as shown in FIGS. 6 and 9–11, or rounded in profile, as shown in FIG. 7, or any other suitable profile which provides an aperture 122*a* when joined to exterior surface 132*e*. The material used for locking block 122 is the same as that used for locking block 22; that is, it must be compatible with the material used for body 132.

A tongue 140 extends outwardly from, and is formed unitarily with, end edge 134*b* of sleeve portion 134, in axial alignment with locking block 122. Thus, the tongue 140 of one tube shield 130 can be inserted into the locking block 122 of a second, adjacent tube shield 130 to lock the two adjacent tube shields together. Tongue 140 of the end-most or bottom-most tube shield 130 is inserted into a locking block 22 on tube 20 as described above with respect to the first embodiment.

Body portion 132 is further held in place on tube 20 by a pair of retainer straps 50 and 52 identical to those described above with respect to the first embodiment.

Figure 14:
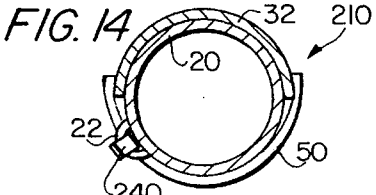
FIG. 14 is a cross-sectional view taken along line 14—14 of FIG. 12.
Figure 12:
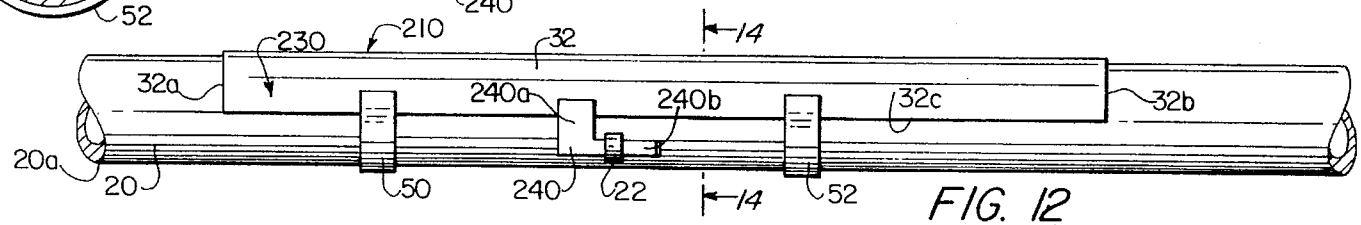
FIG. 12 is a side elevational view of a tube and tube shield assembly in accordance with a third embodiment of the present invention.
Figure 13:
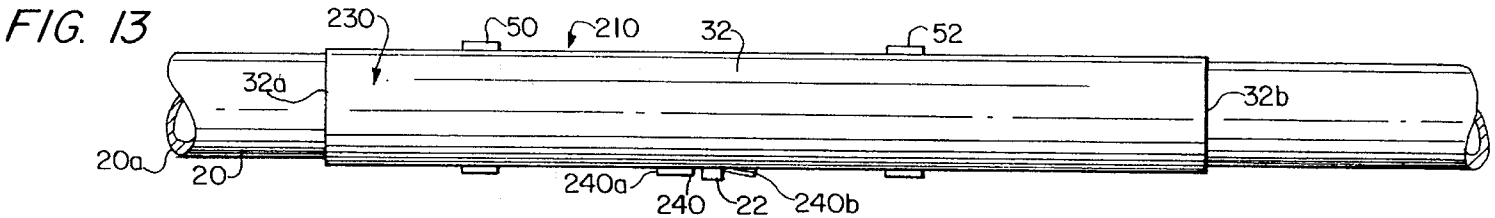
FIG. 13 is a front elevational view of the tube and tube shield assembly of FIG. 12.

Referring now to FIGS. 12–14, there is shown a tube and tube shield assembly 210 in accordance with a third embodiment of the present invention. Tube and tube shield assembly 210 comprises a cylindrical tube 20 identical to that described above with respect to the first embodiment and a tube shield 230 assembled to tube 20. A locking block 22 identical to that described above with respect to the first embodiment is affixed to and extends radially outwardly from the exterior surface 20*a* of tube 20.

Tube shield 230 has a body portion 32 identical to body portion 32 described above with respect to the first embodiment. Tube shield 230 differs from tube shield 30 in the position and configuration of its tongue 240. Tongue 240 is formed unitarily with body portion 32 and is generally L-shaped, having a first leg 240*a* extending outwardly from first side edge 32*c* of body portion 32, and a second leg 240*b* extending generally perpendicular to the first leg 240*a* and parallel to first side edge 32*c*. Tongue 240 can be positioned approximately midway between end edges 32*a* and 32*b*, as shown in FIGS. 12 and 13, or it can be positioned off-center, if required by a specific application. The second leg of tongue 240 is inserted into locking block 22 and then bent outwardly from tube 20 to hold tube shield 210 in place on tube 20.

Body portion 32 is further held in place on tube 20 by a pair of retainer straps 50 and 52 identical to those described above with respect to the first embodiment.

Figure 15:
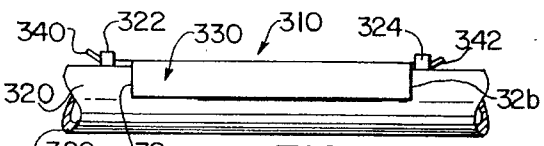
FIG. 15 is a side elevational view of a tube and tube shield assembly in accordance with a third embodiment of the present invention.

Referring now to FIG. 15, there is shown a tube and tube shield assembly 310 in accordance with a fourth embodiment of the invention. Tube and tube shield assembly 310 comprises a cylindrical tube 320 and a tube shield 330 assembled to tube 320. Tube 320 has an exterior surface 320*a* and first and second spaced-apart locking blocks 322 and 324 affixed to and extending radially outwardly from exterior surface 320*a*. Locking blocks 322 and 324 are identical in their configuration and composition to locking block 22 described above with respect to the first embodiment.

Tube shield 330 includes a semi-cylindrical body portion 32 identical to that described above with respect to the first embodiment. Body portion 32 is shorter than the distance between locking blocks 322 and 324, as will be described in greater detail hereinafter. First and second tongues 340 and 342 extend outwardly from, and are formed unitarily with, first and second end edges 32*a* and 32*b*, respectively.

First tongue 340 is longer than second tongue 342, and the distance between locking blocks 322 and 324 is approximately equal to the combined length of body portion 32 and second tongue 342. First tongue 340 is inserted first into its respective locking block 322. Body portion 32 is then slid toward first locking block 322, allowing second tongue 342 to be aligned with the aperture of its respective locking block 324. Once second tongue 342 is aligned with the aperture, body portion 32 can be slid back toward second locking block 324 to insert tongue 342 into the aperture of second locking block 324.

Because first tongue 340 is longer than second tongue 342, and locking blocks 322 and 324 are separated by a distance approximately equal to the combined length of body portion 32 and second tongue 342, when body portion 32 is positioned against locking block 324 with second tongue 342 inserted through second locking block 324, first tongue 340 will still extend through first locking block 322.

Both tongues 340 and 342 can then be bent away from tube 320 to retain tube shield 330 in place.

Tube and tube shield assembly 310 can be oriented either horizontally or vertically. Use of tube and tube shield assembly 310 is particularly appropriate in the case of short tubes 320, as the use of additional retaining means such as retainer straps 50 and 52 is not necessary.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A tube and tube shield assembly comprising:

a cylindrical tube having an exterior surface and a locking block extending radially outwardly from said exterior surface, said cylindrical tube having an outer radius, and said locking block having an aperture therethrough; and a tube shield mounted on said tube immediately above said locking block, said tube shield including:

a semi-cylindrical body portion having an inner radius substantially equal to said outer radius of said tube, said body portion having first and second opposed end edges and first and second opposed side edges; and a tongue extending outwardly from one of said edges and inserted through said aperture in said locking block.

2. The assembly of claim 1, wherein said tongue is bent away from said tube to lock said tongue in place.

3. The assembly of claim 1, wherein said locking block is generally U-shaped.

4. The assembly of claim 1, further comprising retaining means for retaining said body portion in tight engagement with said tube.

5. The assembly of claim 4, wherein said retaining means comprises first and second retaining straps inset from said first and second end edges, respectively, of said body portion, each of said retaining straps having ends overlapping said side edges of said body portion.

6. The assembly of claim 1, wherein said tongue extends outwardly from one of said end edges.

7. The assembly of claim 1, wherein said tongue extends outwardly from one of said side edges intermediate said first and second retaining straps.

8. The assembly of claim 7, wherein said tongue is generally L-shaped, having a first leg extending outwardly from one of said side edges and a second edge extending parallel to said one of said side edges.

9. A tube shield for placement around a cylindrical tube having a locking block extending radially therefrom, the tube having an outer radius, and the locking block having an aperture therethrough, said tube shield comprising:

a semi-cylindrical body portion having an inner radius substantially equal to the outer radius of the tube, said body portion having first and second opposed end edges and first and second opposed side edges;

a tongue extending outwardly from one of said edges, said tongue being dimensioned for insertion through the aperture in the locking block; and first and second retaining straps inset from said first and second end edges, respectively, of said body portion, each of said retaining straps having ends overlapping said side edges of said body portion.

10. The assembly of claim 9, wherein said tongue is bent away from said tube to lock said tongue in place.

11. The assembly of claim 9, wherein said tongue extends outwardly from one of said end edges.

12. The assembly of claim 9, wherein said tongue extends outwardly from one of said side edges intermediate said first and second retaining straps.

13. The assembly of claim 12, wherein said tongue is generally L-shaped, having a first leg extending outwardly from one of said side edges, and a second edge extending parallel to said one of said side edges.

14. A tube and tube shield assembly comprising:

a cylindrical tube having an outer radius, an exterior surface, and first and second spaced locking blocks extending radially outwardly from said exterior surface, said locking blocks each having an aperture therethrough; and a tube shield mounted on said tube immediately adjacent said locking block, said tube shield including:

a semi-cylindrical body portion having an inner radius substantially equal to said outer radius of said tube, said body portion having first and second opposed end edges and first and second opposed side edges; and first and second tongues extending outwardly from one said first and second end edges, respectively, and inserted through said apertures in said first and second locking blocks, respectively.

15. The assembly of claim 14, wherein said first and second tongues are bent away from said tube to lock said first and second tongues in place.

16. The assembly of claim 14, wherein said first and second locking blocks are generally U-shaped.

17. The assembly of claim 14, wherein said first tongue is longer than said second tongue, and said first and second locking blocks are separated by a distance approximately equal to the combined length of said body portion and said second tongue.

18. A tube shield for placement around a cylindrical tube having first and second spaced locking blocks extending radially therefrom, the tube having an outer radius, and the locking blocks each having an aperture therethrough, said tube shield comprising:

a semi-cylindrical body portion having an inner radius substantially equal to the outer radius of the tube, said body portion having first and second opposed end edges and first and second opposed side edges;

first and second tongues extending outwardly from said first and second end edges, respectively, said tongues being dimensioned for insertion through the apertures in the first and second locking blocks, said first tongue being longer than said second tongue, and the combined length of said body portion and said second tongue being approximately equal to the distance between the first and second locking blocks.

19. A tube shield for placement around a cylindrical tube having an outer radius, said tube shield comprising:

a semi-cylindrical body portion having and outer radius, an inner radius, first and second opposed end edges, and first and second opposed side edges, said inner radius being substantially equal to that of the outer radius of the tube;

an enlarged semi-cylindrical sleeve portion coaxial with and extending outwardly with from said first end edge of said body portion, said sleeve portion having an inner radius substantially equal to said outer radius of said body portion, a transition portion joined to said second end edge of said body portion, an end edge opposite said transition portion, and first and second opposed side edges co-extensive with said first and second side edges of said body portion;

a locking block extending radially outwardly from said exterior surface of said body portion, said locking block being inset from said first edge of said body portion by a distance approximately equal to the length of said sleeve portion, and said locking block having an aperture therethrough; and a tongue extending outwardly from said end edge of said sleeve portion, said tongue being dimensioned for insertion through said aperture in said locking block.

20. The tube shield of claim 19, further comprising retaining means for retaining said body portion in tight engagement with the tube.

21. The assembly of claim 20, wherein said retaining means comprises first and second retaining straps inset from said first and second end edges, respectively, of said body portion, each of said retaining straps having ends overlapping said side edges of said body portion.

* * * * *